US007592053B2

(12) United States Patent
Mansfield

(10) Patent No.: US 7,592,053 B2
(45) Date of Patent: Sep. 22, 2009

(54) ORNAMENTAL FIGURE CONSTRUCTION KIT

(76) Inventor: Lee Anne Mansfield, P.O. 453, Myakka City, FL (US) 34251

( * ) Notice: Subject to any disclaimer, the term of this patent is extended or adjusted under 35 U.S.C. 154(b) by 463 days.

(21) Appl. No.: 10/965,755

(22) Filed: Oct. 18, 2004

(65) Prior Publication Data

US 2005/0081442 A1 Apr. 21, 2005

Related U.S. Application Data

(60) Provisional application No. 60/512,558, filed on Oct. 17, 2003.

(51) Int. Cl.

| | |
|---|---|
| ***A45B 19/00*** | (2006.01) |
| ***A47G 35/00*** | (2006.01) |
| ***A63H 33/00*** | (2006.01) |
| ***A63H 7/00*** | (2006.01) |
| ***A63H 11/12*** | (2006.01) |

(52) U.S. Cl. ..... 428/12; 428/542.2; 446/487; 446/356; 446/278

(58) Field of Classification Search ..... 446/487, 446/356, 278; 428/7, 12; 47/83; 108/107, 108/192, 147.13, 147.14, 147.15, 147.17, 108/147.11, 180, 106; 74/469, 96; 414/1; 901/28; 180/8.6

See application file for complete search history.

(56) References Cited

U.S. PATENT DOCUMENTS

| | | | | |
|---|---|---|---|---|
| 1,555,661 A | | 9/1925 | Grove | |
| 2,009,867 A | | 7/1935 | Ball | 47/44 |
| 3,037,320 A | | 6/1962 | Powell | |
| 4,196,542 A | | 4/1980 | West | 47/4 |
| 4,484,406 A | * | 11/1984 | Matsumoto et al. | 446/487 |
| 4,635,563 A | * | 1/1987 | Hand et al. | 108/107 |
| 4,730,863 A | * | 3/1988 | Guadnola | 294/156 |
| 4,757,641 A | | 7/1988 | Penrod | |
| 4,869,704 A | | 9/1989 | Fisher | |
| 5,516,314 A | | 5/1996 | Anderson | 446/374 |
| 5,989,095 A | | 11/1999 | Wotton | 446/385 |
| 6,092,333 A | * | 7/2000 | Steffan | 47/83 |
| 6,180,193 B1 | | 1/2001 | Bostedt | 428/7 |

(Continued)

FOREIGN PATENT DOCUMENTS

DE 195 40 211 A1 4/1997

OTHER PUBLICATIONS

Merriam-Webster on-line dictionary definition of interlocking.*

(Continued)

*Primary Examiner*—Timothy M Speer
*Assistant Examiner*—Gordon R Baldwin
(74) *Attorney, Agent, or Firm*—Mark Douma

(57) ABSTRACT

An ornamental figure construction kit of parts comprising a plurality of elongated structures having a plurality of article stop restraints, at least one locking structure, and at least one lock engagement and a plurality of construction article stops mountable adjacent the article stop restraints on the elongated structures. In one version, plastic rods with a plurality of spherical enlargements at intervals along the rod are terminated in a plate having an aperture for passing other rods through it. Plastic discs, when mounted on the rods, can be used to position construction articles such as clay pots or aid in locking two rods together. Typically, the ornamental figures are used in lawns or gardens.

19 Claims, 4 Drawing Sheets

U.S. PATENT DOCUMENTS

| | | | | |
|---|---|---|---|---|
| 6,217,406 | B1 | 4/2001 | Ross | 446/370 |
| 6,298,599 | B1 | 10/2001 | Weiner | 47/65.5 |
| 6,311,427 | B1 | 11/2001 | McNally | 47/29 |
| 6,478,653 | B1 | 11/2002 | Langton | 446/373 |
| 6,497,498 | B2 | 12/2002 | Adams | 362/252 |

OTHER PUBLICATIONS

"Annies Bag-of-Bones," www.anniesbagofbones.com about Sep. 22, 2003.

M. Braga, "Annie's Bag O Bones," Sarasota Herald-Tribune, Sep. 18, 2003, pp. 1D and 3D.

Bena Miller WO/2005/039720 International Search Report (ISR), May 5, 2006—3 pp. WIPO.

Bena Miller WO/2005/039720 International Preliminary Report on Patentability (IPRP1), Apr. 18, 2006—3 pp. WIPO.

Bena Miller WO/2005/039720 Written Opinion of the ISA (WOSA), Apr. 17, 2006—4 pp. WIPO.

* cited by examiner

ORNAMENTAL FIGURE CONSTRUCTION KIT

CROSS REFERENCE TO RELATED APPLICATIONS

This application claims priority to U.S. provisional application Ser. No. 60/512,558, filed on Oct. 17, 2003, incorporated herein by reference.

BACKGROUND

1. Technical Field

This invention is in the field of ornamental figures for lawns and gardens and, in particular, relates to apparatus for constructing such figures.

2. Background

Ornamental figures for lawns and gardens are quite popular, especially in warmer climates. Mass produced items are made from plastic. Plaster of Paris figures from molds are also popular. Wire frames have been used with a fabric or other covering. Even decorated plastic bags filled with tree leaves are used for construction of Halloween figures in the U.S.

Another construction material is flower pots or clay pots. These are readily available, relatively inexpensive starting materials, ideally suited for weathering outdoor elements. Moreover, they are esthetically suitable for lawn and garden settings.

A search on the Internet for "clay pot people" turned up about 157,000 results. This includes people making clay pots. A quick perusal of the first few results indicated that there was great interest, both amateur and commercial, in using clay pots for figures and other ornamental designs. However, it appeared that the majority decorated a single pot. Occasionally a stack of two clay pots, the one on the bottom being inverted, was used. No one seemed to have attempted using a larger number of pots.

Problems with using a large number of clay pots are that a nested stack would use too many pots per unit of height and stacks with pots rim-to-rim would be unstable. Thus, until this invention, people have been limited to using one or two clay pots to produce ornamental figures.

An apparatus that would allow the use of a number of clay pots would be a boon to lawn and garden ornamental design. However, to be a practical success, such apparatus must be very inexpensive and simple to assemble. Mechanically, it must be light, yet strong enough to support clay pots. It should be neither so rigid that pots cannot be oriented at different angles nor so flexible that pots are oriented solely by gravity. To save costs, there should be as few different parts as possible. Of course, it should not have sharp points, edges, or rough areas. Although it is not essential to meet all of these goals to practice the invention, each is desirable. So far, however, there is nothing available on the market to meet even the overall need.

SUMMARY

The objectives of the invention are realized with a kit of parts comprising a plurality of elongated structures having a plurality of article stop restraints, at least one locking structure, and at least one lock engagement and a plurality of construction article stops mountable on the article stop restraints on the elongated structures.

In particular, the elongated structures can be plastic rods about 18 inches long and 3/16 inch diameter having 3/8 inch diameter spherical enlargements at 2¾ inch intervals. At one end of the rods, there is a plate having an aperture with a clearance hole for the spherical enlargements and a passageway to a locking hole that admits the rods, but is too small for the spherical enlargements. The article stops can be made from discs about 1¼ inch diameter and 1/8 inch thick having a slot to the center that is wide enough for the rods but too narrow for the spherical enlargements. Thus, when the discs are mounted on a rod, the spherical enlargements restrain the discs from moving in one direction. The construction articles can be, for example, clay pots or other similar articles having a hole in the bottom larger than the rods but smaller than the discs.

A spherical enlargement on the end of one rod can engage the locking structure on the end of another rod so that a 36 inch composite rod can be formed from two 18 inch rods. (Except where noted below, most dimensions are approximate and provided as aids to visualization only and are not a limitation on the invention.)

DESCRIPTION OF THE FIGURES

The features and advantages of the invention will now be described in more detail with a detailed description making reference to the following appended drawings.

DETAILED DESCRIPTION

Working Example

Figure 1:
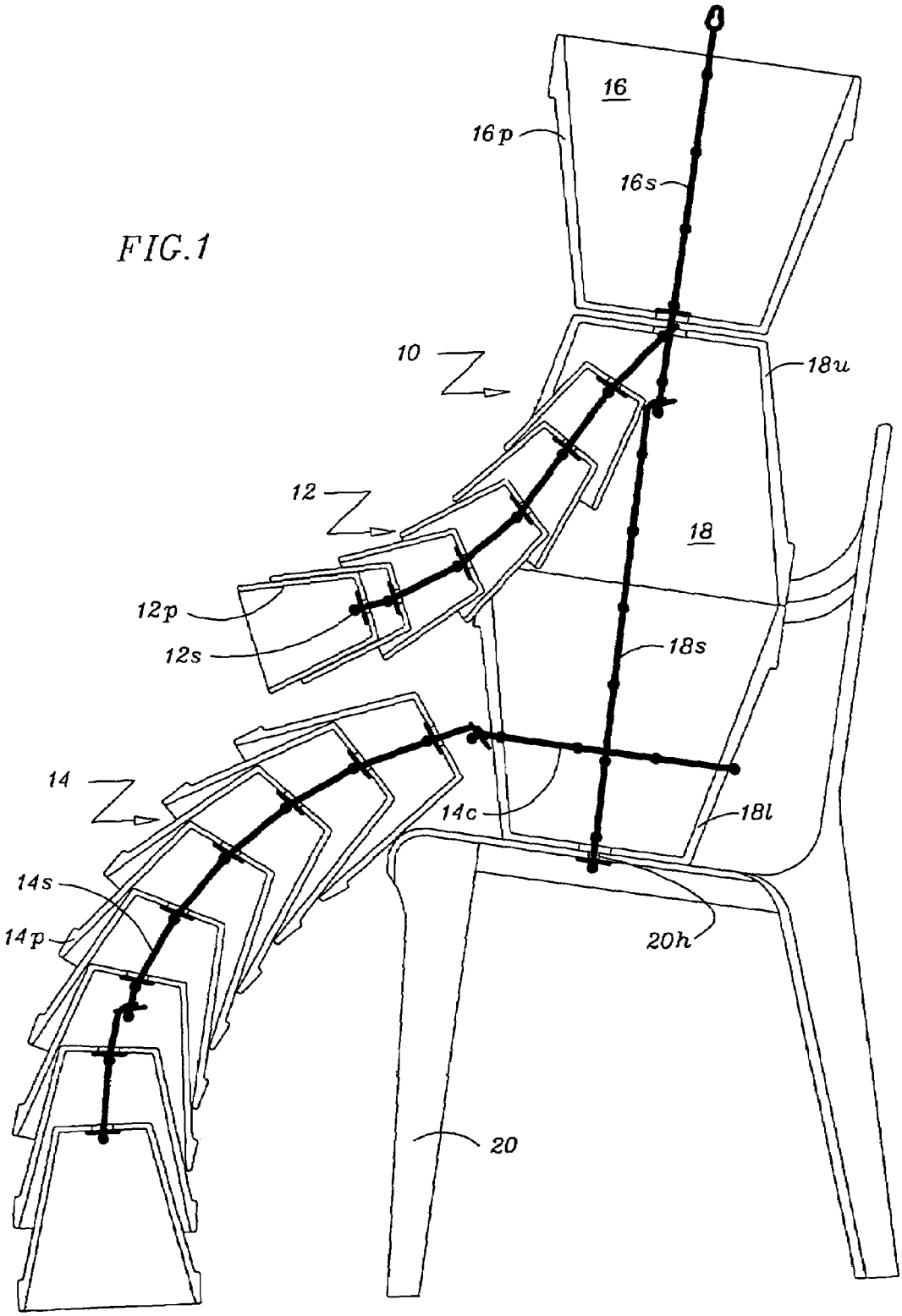
FIG. 1 illustrates the invention being used to construct an ornamental figure from a variety of sizes of clay pots assembled from a kit of rods and discs.

FIG. 1 illustrates a working example of the invention. In this example, an ornamental figure 10 that simulates a human figure was constructed from common flower pots. The figure is shown with various cross-sections sitting on a chair 20. It comprised arms 12 and legs 14, one each of which is shown, and a head 16 on a torso 18.

The arms comprised a plurality of pots 12*p* held together by the structure 12*s*. In the working example, each arm used six 4 inch diameter clay pots. Likewise, the legs were formed from a plurality of pots 14*p* held up by the structure 14*s*. Each leg used eight 6 inch diameter clay pots. The torso was comprised of a lower pot 18*l* and an upper pot 18*u* with support structure 18*s* on which a single pot 16*p* is the head, held in place by the structure 16*s*. The working example used 10 inch diameter pots for the torso and an 8 inch diameter pot for the head.

As partially illustrated, the leg support structures 14*s* wrapped around the back of the bottom torso pot 18*l* and connected to each other using rod 14*c*. The arm support structures 12*s* were connected via a gap between the upper torso pot 18*u* and head pot 16*p*. The chair 20 had a hole 20*h* that was used to anchor the figure 10.

Figure 2A:
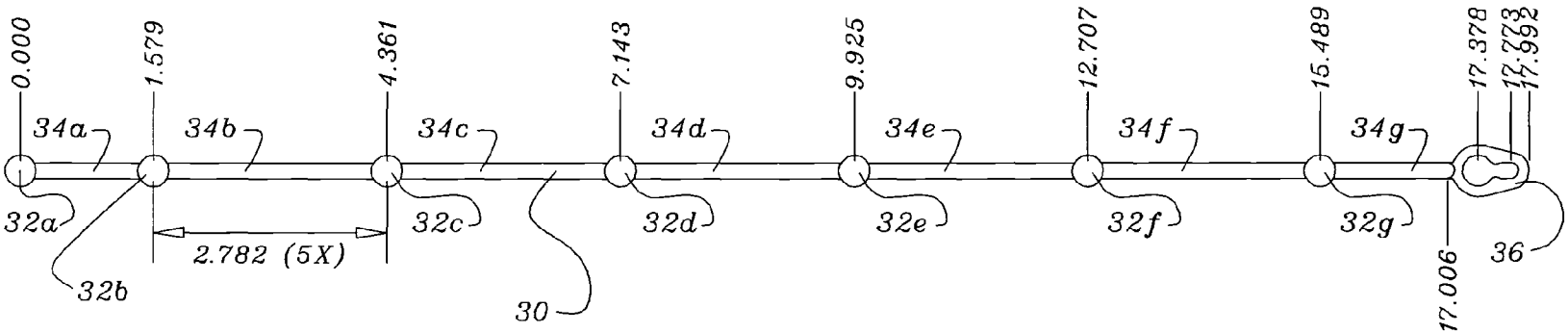
FIG. 2*a* shows a top view of one of the rods in FIG. 1 having spherical enlargements and an end plate.
Figure 2B:
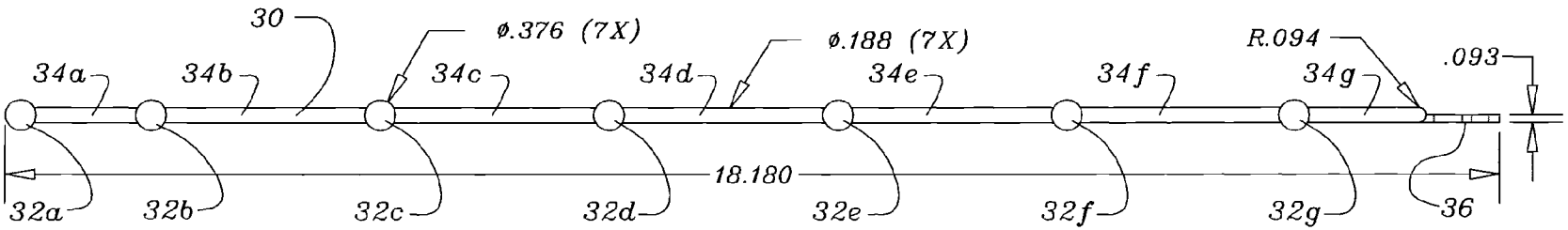
FIG. 2*b* shows a side view of the rod in FIG. 2*a;*

The various support structures in FIG. 1 were made from plastic rods and discs as illustrated in FIGS. 2 & 3. FIG. 2*a* shows a top view of rods 30 with dimensions in inches and FIG. 2*b* shows a side view. The rods have a plurality of equal-size, spherical enlargements or balls 32*a*-32*g* that are mechanically connected with respective bars 34*a*-32*g*. One end of the rod is terminated in a flat end plate 36. Note that the end plate 36 joins the approximate bottom (as illustrated) half of the rod bar 34*g*. The balls 32*b*-32*g* are equally spaced in the working example, but the end ball 32*a* is closer to the next ball 32*b* than the spacing between the other balls.

Figure 2C:
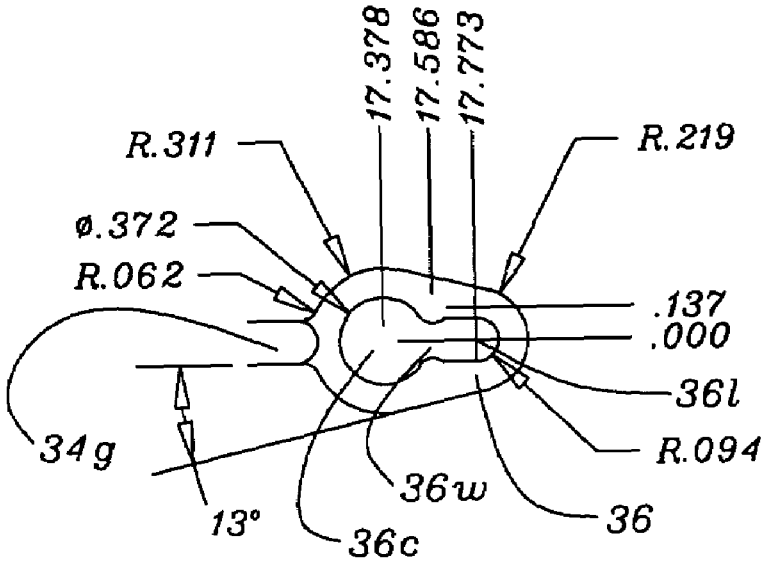
FIG. 2*c* shows an enlargement of the end plate in FIG. 2*a;*

FIG. 2*c* illustrates the end plate 36 in more detail. This plate has an aperture comprising a larger clearance hole 36*c* and a smaller locking hole 36*l*that are connected by a passage 36*w*. The diameter of the clearance hole 36*c* is approximately the same as the diameter of the balls 32*a*- 32*g* and the diameter of the locking hole 36*l*is approximately the same as the diameter of the bars 34*a*-34*g*. However, a portion of the width of the passageway 36*w* is slightly less than the diameter of the bars. Note that the overall 0.622 inch width (which can be inferred from the other dimensions) of an end plate 36 is enough less than the 0.675 inch distance (also inferable) between the extremes of hole 36*c* and 36*l*so that one end plate can pass through another. (This is an example of more critical dimensions, namely, for use as a locking engagement, the width of a plate 36 be less than the aperture inside one. Other examples should be obvious to those skilled in the relevant arts and will not be pointed out.)

Figure 3A:
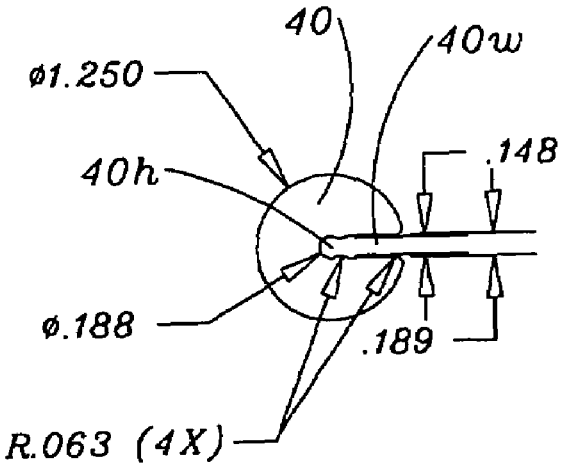
FIG. 3*a* shows a top view of one of the discs in FIG. 1.
Figure 3B:
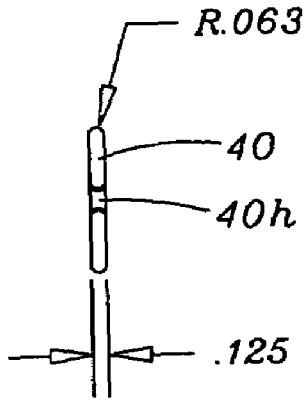
FIG. 3*b* shows a side view of the disc in FIG. 3*a;*

FIG. 3*a* is a top view and FIG. 3*b* is a side view of the discs 40 used in the construction of the figure 10. In the working example, these have a diameter of 1.250 inches with a central hole 40*h* and a slot-like passageway 40*w* to the circumference. The diameter of the hole 40*h* is approximately the same as the diameter of the bars 34*a*-34*g*. However, a portion of the width of the passageway 40*w* is slightly less than the diameter of the bars. The 0.625 inch radius of a disc 40 is approximately the same as the distance from the center of a locking hole 36*l* of an end plate 36 to its juncture with a bar 34*g*. The significance of this will become apparent below. The 0.125 inch thickness of the discs 40 allows them to nest on top of end plates 36.

In the working example, the rods 30 and discs 40 were made from injection-molded polypropylene using a well know cold runner mold process. The polypropylene was a mixture of 70% virgin material and 30% reground scrap. This produced low cost, strong, tough, yet flexible parts. The working example rods are flexible enough to be manually bent into a complete circle. It is well know that up to 50% reground scrap can be used with not much effect on material properties. An appliance white colorant was used with a UV-oxidation inhibitor for outdoor use. In larger scale production, a hot manifold process would be preferable. It is believed that making and modifying the injection molding process for the invention would be routine for those skilled in the art of plastics manufacture.

The working example illustrated in FIG. 1 used 9 rods 30 and 35 disks 40 for construction of the supporting structures. Using the discs 40, the rods can be assembled together in two ways, hereinafter designated as a "ball-to-plate connection" or a "plate-to-plate connection" to make an extended rod. A third method of assembly, useful in come cases, is to simply pass a rod through the clearance hole 36*c* in one or more rod end plates 36.

Figure 4A:
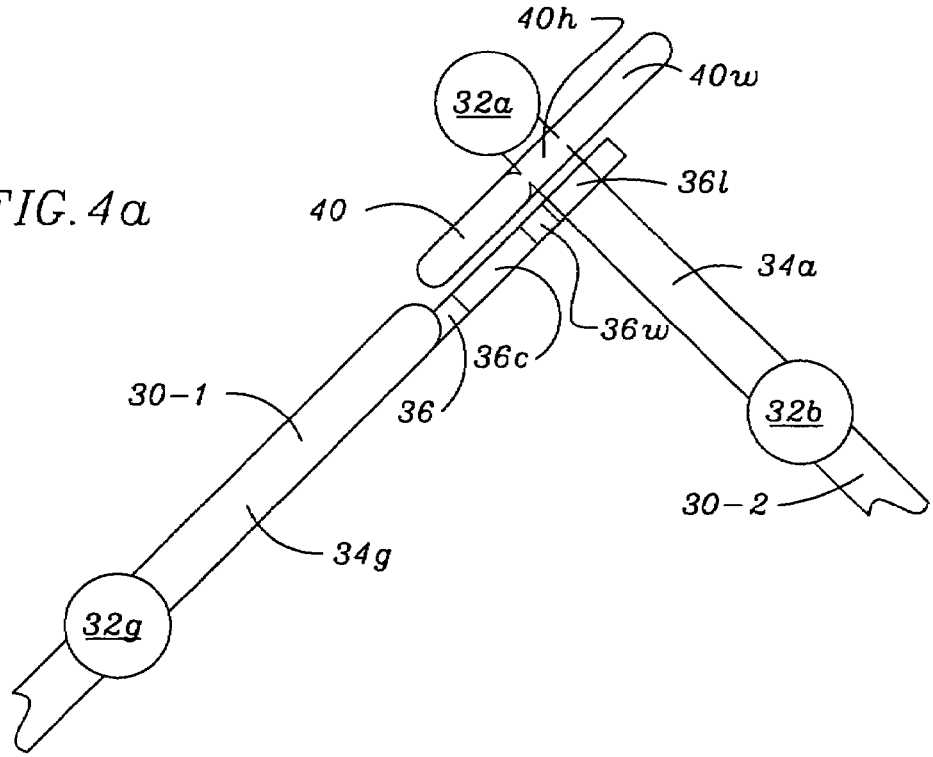
FIG. 4*a* shows a side view of two rods and a disc in a "ball-to-plate" locked engagement.

FIG. 4*a* illustrates a ball-to-plate connection between two rods 30-1 and 30-2. The end ball 32*a* of a rod 30-2 is inserted through the clearance hole 36*c* of a rod 30-1 and the bar 32*a* is pushed through the passageway 36*w* into the locking hole 36*l*. In the working example, moving the bar 34*a* through the passageway 36*w* requires moderate hand pressure and results in an audible snap. A disc 40 is then inserted over the bar 34*a* of rod 30-2 between the end ball 32*a* of rod 30-2 and plate 36 of rod 30-1 until bar 34*a* is located in the hole 40*h*. This also requires moderate hand pressure and results in an audible snap. Hereinafter, "snap" will be used as a verb meaning to push a disc 40 over a bar 34*a*-34*g* until the bar is located in the hole 40*h*.

Note that the disc 40 is rotated until its slot 40*w* is directed away from the rod 30-1. With the dimensions in the working example, the disc 40 is nested against the end plate 36 butting against the bar 34*g* of the rod. When tension is applied to rods 30-1 and 30-2, even though they bend, end ball 32*a* and plate 36 press on disc 40 and lock it into position against bar 34*g*.

In some situations, a disc 40 is not required. If the rods 30 are put under enough opposing tension before being rotated, the ball 32*a* will not rotate out through clearance hole 36*c*, but will be locked into hole 36*l*. Usually, however, it will be convenient to use a disc 40.

The reason for the lesser spacing of end ball 32*a* and from ball 32*b* is to provide approximately constant ball spacing across two connected rods. When the rods 30-1 and 30-2 are pulled under tension and rotated into an approximate straight line, the distance between ball 32*g* on rod 30-1 and ball 32*b* on rod 30-2 is approximately the same as the distance between other balls that do not take part in connections.

Figure 4B:
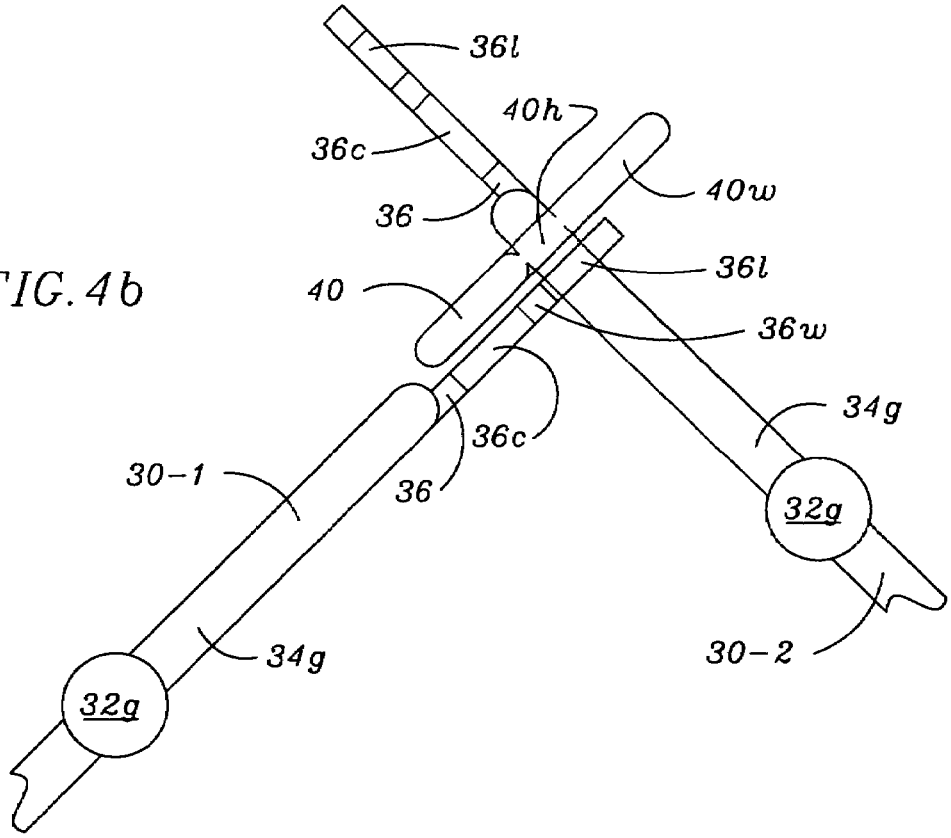
FIG. 4*b* shows a side view of two rods and a disc in a "plate-to-plate" locked engagement.

FIG. 4*b* illustrates the second way to make an extended rod. In this, the end plate 36 of a rod 30-2 is inserted through the end plate 36 of rod 30-1 and pushed into the locking hole 36*l* of rod 30-2. Once the rod 30-2 is rotated 90 degrees, there is little tendency for its end plate to pull through under tension because, unlike an end ball, it is too wide to be rotated out.

For more security, a disc 40 can be snapped onto bar 34*g* of rod 30-2 between plate 36 of rod 30-1 and plate 36 of rod 30-2. As in the ball-to-plate connection, the disc 40 is rotated until its slot is directed away from the rod 30-1. Also, preferably, the end plate 36 of rod 30-2 is directed away from rod 30-1. With these orientations, disc 40 fits more securely against both flat plates. When the rods are under tension, there is no tendency for them to break free.

One method for assembling the ornamental figure in FIG. 1 will now be described. First, it should be noted that, if clay pots are used, consideration must be given to the fact that they are not particularly light. A leg formed from eight 6 inch clay pots can weigh about 13 pounds. Nonetheless, the method give below has been feasible for most people.

First, the ornamental figure in FIG. 1 will require the kit of 9 rods 30 and 35 discs 40 plus, as shown, 12 pots—4 inch diameter, 16 pots—6 inch diameter, 1 pot—8 inch diameter, 2 pots—10 inch diameter, and a chair. It is preferable that, at least the larger three pot sizes pots have drain holes in the bottom large enough to pass the rod end plates 36, but small enough to stop the discs 40. For clay flower pots, this is commonly the case for these three sizes. However, 4 inch diameter pots have drainage holes that are large enough to pass the balls 32 on the rods 30, but are too small to pass the end plates 36 and require a modified construction technique.

The figure shown in FIG. 1 has been built, but the process will be described in the present tense. As noted previously, there are many interchangeable parts and different reference numerals will not be used for the same part used in different locations.

The first step is to mount the torso 18 on the chair 20. Chairs with existing holes through the seat, such as wicker or metal mesh, may be used. If a chair with a solid base is used, a 10 inch pot should be positioned in the chair as desired. Positioning toward the back would make it possible to put a potted plant or other addition between the legs of the figure. After marking the drain hole position, the pot should be removed and a hole of about 0.375 inch diameter drilled through the chair seat. Then, replace the 10 inch pot 18*l*. Insert a rod 30 through the pot and chair hole 20*h* until a ball 32*b* and bar 34*b* protrude. Snap a disc 40 over bar 34*b* so that it cannot be pulled through the hole. Using a second rod 30, make a ball-to-plate connection to the first rod 30. Slip the end plate 36 of the second rod 30 through the drain hole in a second 10 inch pot 18*u*, oriented upside down as shown in FIG. 1. Snap a disc over the second rod 30 on the outside of the pot 18*u*. This completes the torso.

The legs 14 are built as a vertical stack and then attached to the torso 18. The number of pots required may vary with the height of the chair. Using two connected rods 30, as many as eleven pots can be equally spaced in a stack. FIG. 1 illustrates an eight pot stack. This is obtained by cutting a rod 30, below its ball 32*f*. (With the plastic rods in the working example, either a saw or sturdy wire cutter is adequate.) Then, snap a disc 40 over the bar 32*f*. Slide the rod through the drain hole in an inverted 8 inch pot. Snap a disc over bar 32*g* and slide the rod through a second 8 inch pot. Then, make a ball-to-end connection with a second rod 30. Snap a disc over bar 32*b* of the second rod and add a third pot. Continue until an eighth pot is added at the disc snapped over bar 32*g* of the second rod 30. Repeat the process for a second leg 14.

The legs 14 may be secured to the torso 18 using a connecting rod 14*c* between the legs. After positioning the legs where desired, make a ball-to-plate connection to one leg and wrap rod 14*c* around the torso pot 18*l*, as illustrated in FIG. 1. Then make a plate-to-plate connection to the other leg (not shown). If rod 14*c* is too long, a rod-to-plate connection can be made using one of the intermediate balls 34*b*-32*g*. If one rod is not long enough, two rods can be used to make a longer connection 14*c*.

For the arms 12, as illustrated in FIG. 1, 6 pots are used. Because drain holes for common 4 inch diameter clay pots are too small for the end plate 36, the procedure for the arms is slightly different; the arms are built from the top down. It may be convenient to lay the pots on their sides. Slide a first rod 30, ball end first, through a first pot until the end plate 36 and ball 32*g* protrude from the bottom. (The extra length will be used later.) Reach inside the first pot and snap a disc over bar 32*f*. Next, slide a second pot, bottom side first, up the rod as far as possible. Reach inside the second pot and snap a disc over bar 32*e*. Similarly, slide on four more pots and sequentially snap four more discs over bars 32*d*, 32*c*, 32*b*, and 32*a*. In a similar manner make a second arm.

When the two arms are finished, rods with bar sections 32*f* and 32*g* and endplates 36 should be protruding from the top pots. These two endplates are then slipped over the head support bar 16*s* protruding through the torso pot 18*u*. Then, head pot 16*p* is slipped over support 16*s* down onto arm supports 12*s* to help anchor the arms 12. One or more discs 40 (one is illustrated in FIG. 1) are snapped onto support 16*s* inside the head pot 16*p* near its inside bottom to keep it stable.

The basic figure can now be decorated in any number of ways. For example, a fern plant can be added to the head pot 16*p* to simulate hair.

The invention is not limited to making clay pot figures. Using the kit of rods and discs, one can make a variety of figures and ornamental designs including boats, flowers, spider webs, dragonflies, etc. These need not be located outside.

Other Equivalent Variations

Although the invention was described with reference to a working example, it should be clear to those skilled in the art that the invention is not limited to the particular method of making the support structures. The dimensions shown in the drawings are a typical example of what appeared to be suitable for clay pots of the sizes used in the working example. There could be a redundant number of spherical enlargements to accommodate more different sizes.

With respect to the rods 30, they need not be exactly as described. The enlargements 32 need not be spherical, but could be cylinders, cones, ellipsoids, or even some ornamental shape. Likewise, the bars 34 need not have a circular cross section. Oval, square, rectangular, or even fanciful ones could be used. Although the rods should not be so rigid that they can't be bent, they should be at least strong enough to be self supporting. The rigidity exhibited by the plastic rods in the working example appears to be a good compromise. This requirement excludes strings, ropes, chains and the like.

Instead of enlargements, the rods could have short segments (e.g., 0.125 inches long to match the width of discs 40) of reduced diameter or width. These short segments would have a diameter or width to match the width of slot 40*s*. The last segment would not be useable unless there was a short segment of a larger bar 34 on the end. This approach means that the discs 40 are restrained from moving in both directions along the rods 30. However, for the rods to have the same tensile strength, the reduced size segments would have to be created by making the size of the bars larger. Whatever the design, the functionally requirement is for a plurality of disc restraints operative in at least one direction. Along the same line, two enlargements could be positioned a short distance apart so that two discs or the equivalent could be located between them with enough spacing to admit a pot or other article and constrain it from moving in both directions.

The flat end plates 36 need not be flat or on the end of a rod 30. An intermediate enlarged segment having an aperture with a clearance hole and a passageway to a smaller locking hole would work as a locking structure. In the case where reduced size segments replace enlargements, the clearance hole would be large enough to clear the bars 34 and the locking hole large enough to accommodate a short segment but not large enough to clear a bar.

The clearance hole 36*c* need not be a hole. Although mechanically weaker, an L-shaped slot could be used on one side of the locking structure 36 with an entrance wide enough for the bars 34 and a passageway to a locking hole. If reduced size segments are used on the rods, they would be locked in both directions. Even with enlargements, a more complicated locking structure could lock the rods in both directions. The functional requirement for the locking structure is that it has clearance for the rods with passage to a locking area that is effective to restrain some locking engagement structure on the rods in at least one direction.

The location of locking structure 36 could be intermediate on the rod 30 between enlargements 32. In that case, ball-to-plate connections or the equivalent could be made at both ends of the rods.

The discs 40 need not be circular plates; they could be squares, rectangles, stars, or three dimensional shapes with slots cut sufficiently deep. The slots 40*w* could be of a uniform width and rely on friction to hold them in place on a bar 34. Instead of a slot from the side, an aperture similar to the one in the plate 36 could be used. A double disc structure with a connection opposite the slots could be used to surround the enlargements 32 and prevent movement in both directions along the rod 30. Functionally, these structures, hereinafter, "article stops," must be mountable on the rods and sized to stop a pot or other construction article from movement along the rods in at least one direction.

It is convenient to use the same features on the rods to restrain the article stops and engage the locking mechanism, but this is not essential. Different shapes could be used to operate as locking engagements and restrain article stops.

To summarize, the rods 30 with bars 34 are an example of an elongated structure, the balls 32 are an example of an article stop restraint and/or lock engagement, the end plate 36 is an example of a locking structure, and the discs 40 are examples of construction article stops.

Lastly, the invention is not limited to using clay pots or even flower pots. It would be useful for just about any construction articles that have a shape that allows nesting. An example would be plastic cones with a hole at the apex. The minimal requirement is that the articles have a hole on one end smaller than an article stop and a hole on another end larger than an article stop.

What is claimed is:

1. An ornamental figure construction kit for positioning a plurality of construction articles comprising:

a plurality of self-supporting elongated integral structures having article stop restraints at a plurality of places, at least one locking structure, and at least one lock engagement adapted to engage the locking structure of another of said elongated structures; and a plurality of construction article stops mountable on said article stop restraints on said elongated structures.

2. The kit of claim 1 wherein said at least one locking structure comprises a plate-like structure having an aperture sized to pass a lock engagement.

3. The kit of claim 1 wherein said elongated structures and article stops are made from injection molded plastic.

4. The kit of claim 1 wherein said locking structure and said lock engagement cooperate to lock said elongated structures so that, once engaged, said elongated structures are prevented from disengagement due to pulling on any two elongated structures.

5. An ornamental figure construction kit for positioning a plurality of construction articles comprising:

a plurality of self-supporting elongated structures having article stop restraints comprising enlargements of said elongated structures at a plurality of places, at least one locking structure, and at least one lock engagement; and a plurality of construction article stops mountable on said article stop restraints on said elongated structures.

6. The kit of claim 5 wherein said article stops comprise discs having slots extending from one edge.

7. The kit of claim 5 wherein said enlargements of said elongated structure are spherical.

8. An ornamental figure construction kit for positioning a plurality of construction articles comprising:

a plurality of self-supporting elongated structures having article stop restraints comprising reduced cross-sections in said elongated structures at a plurality of places, at least one locking structure, and at least one lock engagement; and a plurality of construction article stops mountable on said article stop restraints on said elongated structures.

9. The kit of claim 8 wherein said article stops comprise discs having slots extending from one edge.

10. An ornamental figure construction kit for positioning a plurality of construction articles comprising:

a plurality of self-supporting elongated structures having article stop restraints at a plurality of places, at least one locking structure, and at least one lock engagement, wherein said at least one locking structure comprises a plate-like structure having an aperture sized to pass a lock engagement and wherein said lock engagements are spherical enlargements and said aperture in said plate-like structure has a larger opening at one end to pass said spherical enlargements therethrough; and a plurality of construction article stops mountable on said article stop restraints on said elongated structures.

11. An ornamental figure construction kit for positioning a plurality of construction articles comprising:

a plurality of self-supporting elongated structures having article stop restraints at a plurality of places, at least one locking structure, and at least one lock engagement, wherein said at least one locking structure comprises a plate-like structure having an aperture sized to pass a lock engagement and wherein said plate-like structure has a thickness and width that allows passage through the aperture in another plate-like structure on another elongated structure when oriented approximately perpendicularly; and a plurality of construction article stops mountable on said article stop restraints on said elongated structures.

12. An ornamental figure construction kit for positioning a plurality of construction articles comprising:

a plurality of self-supporting elongated structures having article stop restraints at a plurality of places, at least one locking structure, and at least one lock engagement, wherein said at least one locking structure comprises a plate-like structure having an aperture sized to pass a lock engagement, wherein said construction article stops are discs, and wherein said plate-like structure is offset to a side of said elongated structure and sized to produce a nest for said discs; and a plurality of construction article stops mountable on said article stop restraints on said elongated structures.

13. An ornamental figure construction kit for positioning a plurality of construction articles comprising:

a plurality of self-supporting elongated structures having article stop restraints at a plurality of places, at least one locking structure, and at least one lock engagement, wherein said at least one lock engagement comprises an enlargement of said elongated structure; and a plurality of construction article stops mountable on said article stop restraints on said elongated structures.

14. The kit of claim 13 wherein said enlargement is spherical.

15. An ornamental figure construction kit comprising a plurality of rods having a first end and a second end and having spherical enlargements at the first end and a plurality of places along said rod, a plate-like termination at the second end, said termination having an internal slot generally in line with said rod and having an end adjacent said rod and a distal end wherein the width of said slot adjacent end is large enough to accommodate at least one spherical enlargement and the width at said distal end is small enough to prevent a spherical enlargement from passing therethrough; and a plurality of discs having a slot extending from an edge to an approximate center and having a width that is in a range larger than the diameter of said rods and smaller than the diameter of said spherical enlargements.

16. The kit of claim 15 wherein said plate-like terminations have a thickness and width that allows passage through the slot of another plate-like structure on another rod when oriented approximately perpendicularly.

17. The kit of claim 15 wherein said spherical enlargements at said plurality of places along said rod are spaced at about 2¾ inches so that 4 inch diameter clay pots can be arranged in an aesthetic manner.

18. The kit of claim 15 wherein the distance along any rod between said plate-like termination and the first adjacent spherical enlargement and the distance between said spherical enlargement at the end of any rod and the spherical enlargement adjacent to said plate, when the rods are locked together and put under tension, a spacing between said first adjacent spherical segment and said plate adjacent spherical segment substantially the same as the spacing between said plurality of spherical segments.

19. The kit of claim 15 wherein said rods and discs are constructed from injection molded plastic.

* * * * *